US011237509B2

(12) United States Patent
Miyanishi et al.

(10) Patent No.: US 11,237,509 B2
(45) Date of Patent: Feb. 1, 2022

(54) IMAGE FORMING APPARATUS

(71) Applicant: SHARP KABUSHIKI KAISHA, Sakai (JP)

(72) Inventors: Keisuke Miyanishi, Sakai (JP); Kunihiro Mitsuhashi, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 15/986,247

(22) Filed: May 22, 2018

(65) Prior Publication Data

US 2018/0341206 A1 Nov. 29, 2018

(30) Foreign Application Priority Data

May 23, 2017 (JP) ..... JP2017-101830

(51) Int. Cl.
*G03G 15/00* (2006.01)
*G03G 15/08* (2006.01)
*G03G 21/00* (2006.01)

(52) U.S. Cl.
CPC ..... *G03G 15/5016* (2013.01); *G03G 15/00* (2013.01); *G03G 15/08* (2013.01); *G03G 15/0865* (2013.01); *G03G 15/502* (2013.01); *G03G 21/00* (2013.01); *G03G 15/0848* (2013.01)

(58) Field of Classification Search
CPC ..... G03G 15/0848; G03G 15/5016
See application file for complete search history.

(56) References Cited

U.S. PATENT DOCUMENTS

2007/0237537 A1* 10/2007 Hasegawa ..... G03G 15/55 399/81
2008/0317481 A1* 12/2008 Nagano ..... G03G 15/0875 399/27
2011/0020027 A1* 1/2011 Takubo ..... G06F 3/04886 399/81
2011/0274443 A1* 11/2011 Tohata ..... G03G 15/0863 399/12
2011/0318022 A1* 12/2011 Ajima ..... G03G 15/0848 399/12
2013/0028617 A1* 1/2013 Fukuoka ..... G03G 15/502 399/27
2015/0290394 A1* 10/2015 Murakami ..... A61M 5/20 604/518
2016/0378019 A1* 12/2016 Asaka ..... G03G 15/0891 399/27

FOREIGN PATENT DOCUMENTS

JP 2013050546 A * 3/2013
JP 2015-072316 A 4/2015

* cited by examiner

*Primary Examiner* — Ryan D Walsh
(74) *Attorney, Agent, or Firm* — ScienBiziP, P.C.

(57) ABSTRACT

An image forming apparatus that is replenished with toner by using a toner cartridge serving as a toner container that accommodates toner, which is a consumable, and that is detachable from an apparatus body, includes, as a characteristic component of a control section that controls the image forming apparatus, a display control unit that, when a toner cartridge to be first inserted or a replacing toner cartridge is inserted, causes a display section of an operation panel to display a display (e.g. a message, an image (illustration), a moving image, or the like) that instructs a user in an operation of shaking the toner cartridge.

10 Claims, 12 Drawing Sheets

IMAGE FORMING APPARATUS

BACKGROUND

1. Field

The present disclosure relates to image forming apparatuses and, in particular, to an image forming apparatus that is replenished with toner by using a toner container.

2. Description of the Related Art

In recent years, heavy use has been made of electrophotographic image forming apparatuses, such as copying machines, facsimiles, and printers, each of which is configured such that toner accommodated in a toner container (such as a toner cartridge or a toner bottle) is automatically supplied to a developing device. Moreover, such an image forming apparatus is configured such that a used toner container (hereinafter referred to as "toner cartridge") can be easily replaced with a new one by a user.

Japanese Unexamined Patent Application Publication No. 2015-72316 discloses an image forming apparatus, including a detachable toner cartridge accommodating toner, that forms an image on a recording medium with toner. In the image forming apparatus, a toner cartridge replacement preparation message is displayed in a case where little toner is left in the toner cartridge.

This configuration makes it possible to prepare before toner runs out and, therefore, to efficiently use the apparatus.

However, in a case where a toner cartridge being used runs out of toner and is replaced with a new toner cartridge in the image forming apparatus, even the new toner cartridge may have solidified toner therein, depending on how it has been preserved. In such a case, normal toner replenishment is undesirably disabled in spite of the replacement with the new toner cartridge.

Further, the toner in the toner cartridge may also solidify when the image forming apparatus is not used for a while. In a case where the image forming apparatus is used as is, normal toner replenishment is undesirably disabled.

As noted above, the toner in the toner cartridge may coagulate due to external factors such as the vibration and conditions (temperature and humidity) during transportation, the storage environment (temperature and humidity), and the actual operating conditions (temperature and humidity). The conventional image forming apparatus suffers from trouble that leads to an abnormality in toner replenishment, as coagulated toner is hardly normally supplied to a developing unit.

SUMMARY

It is desirable to provide an image forming apparatus that can achieve normal toner replenishment without solidification of toner in a toner container.

According to an aspect of the disclosure, there is provided an image forming apparatus that is replenished with toner by using a toner container (toner cartridge) that is detachable from an apparatus body, including: a display control unit having a function of causing a display section of the image forming apparatus to display a display (such as a message, an image, or a moving image) that gives instructions in an operation of shaking a toner container to be inserted or a toner container being used.

DESCRIPTION OF THE EMBODIMENTS

First Embodiment

The following describes an embodiment of the present disclosure with reference to the drawings.

Figure 1:
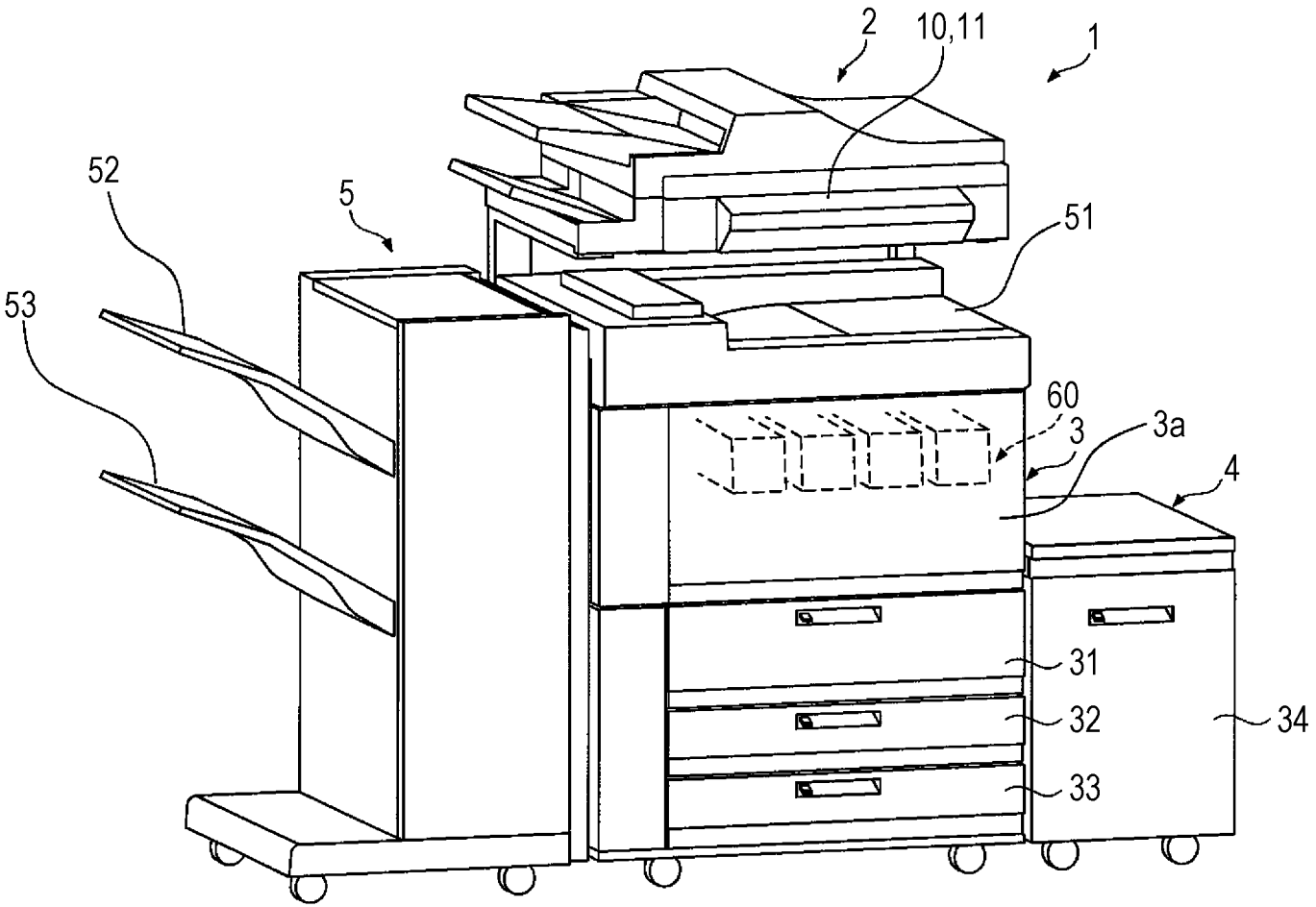
FIG. 1 is an explanatory diagram showing an overall configuration of an image forming apparatus according to a first embodiment.
Figure 2:
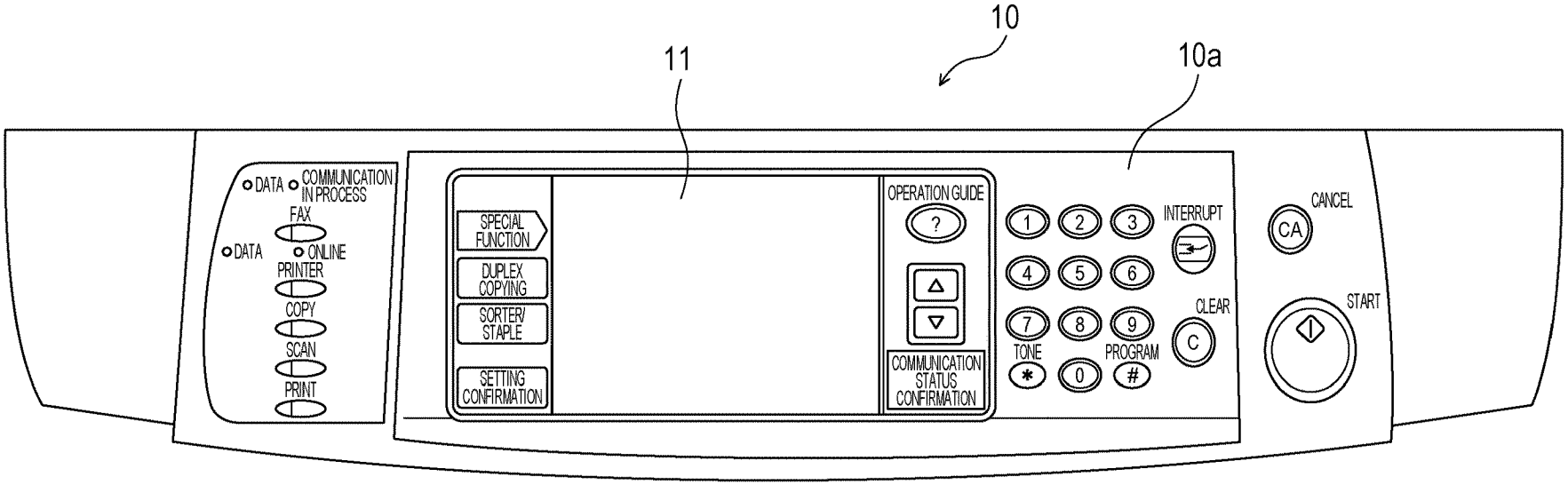
FIG. 2 is an explanatory diagram showing a configuration of an operation panel of the image forming apparatus.

FIG. 1 is an explanatory diagram showing an overall configuration of an image forming apparatus according to a first embodiment of the present disclosure, which is an example of an embodiment of the present disclosure. FIG. 2 is an explanatory diagram showing a configuration of an operation panel of the image forming apparatus.

As shown in FIGS. 1 and 2, a first embodiment is directed to an image forming apparatus 1 that is replenished with toner by using a toner cartridge (toner container) 60 that accommodates toner, which is a consumable, and that is detachable from an apparatus body. The image forming apparatus 1 includes a control section 501 (see FIG. 5) that controls the image forming apparatus 1. A characteristic configuration of the control section 501 is characterized in that when a toner cartridge 60 to be first inserted or a replacing toner cartridge 60 is inserted, the control section 501 causes a display section 11 of an operation panel 10 to display a display (e.g. a message, an image (illustration), a moving image, or the like) that instructs a user in an operation of shaking (waggling) the toner cartridge 60.

Shaking the toner cartridge 60 makes it possible to loosen the toner, which has solidified in the toner cartridge 60 and become hard to convey or stir, and bring the toner back into a state where it can be normally conveyed and stirred.

First, an overall configuration of the image forming apparatus 1 is described.

The image forming apparatus 1 is an apparatus that forms an image on a predetermined sheet of paper (recording sheet, recording medium) in accordance with image data that is transmitted from an outside source. As shown in FIG. 1, the image forming apparatus 1 mainly includes an image forming process section 3 and an image reading section 2. The image forming process section 3 includes an electrophotographic process section (not illustrated) serving as a body apparatus. The image reading section 2 includes the operation panel 10 and a scanner unit (not illustrated).

Image data obtained by reading a document image with the scanner unit is subjected to various types of process and then temporarily stored in a memory. The image data is outputted from the memory to the image forming process section 3 in accordance with an output instruction and reproduced as a visible image on a photosensitive drum (not illustrated), and then the image is transferred onto a sheet of paper to form a toner image.

The image forming process section 3 includes an outer cover 3*a* that opens and closes, and is provided with an opening and closing sensor 70 (not illustrated in FIG. 1; see FIG. 5) that detects whether the outer cover 3*a* is in an open state or a closed state.

A paper feeding section 4 is configured that is situated next to and supplies a sheet of paper to the image forming process section 3.

The paper feeding section 4 has first to third cassettes 31, 32, and 33 and, furthermore, a large-capacity cassette 34, which is an option. The large-capacity cassette 34 can accommodate most frequently used size, e.g. a standard A4 size, of paper in large quantity.

A paper output tray 51 is formed between the image reading section 2 and the image forming process section 3.

A post-processing device 5 is configured that is situated next to the image forming process section 3.

The post-processing device 5 is provided with a first paper output tray 52 and a second paper output tray 53.

As shown in FIG. 2, the operation panel 10 is provided with an operation surface (input section) 10*a* with the display section 11 configured in substantially the central part of the operation surface 10*a*.

It should be noted that the display section 11 does not need to be flush with the operation surface (input section) 10*a* but may be openably and closably movable with respect to the operation surface 10*a* or may be provided separately from the operation surface 10*a*. Alternatively, they may be combined.

The following describes a toner cartridge 60, which is a toner container that is mounted into the image forming apparatus 1 according to the first embodiment.

Figure 3A:
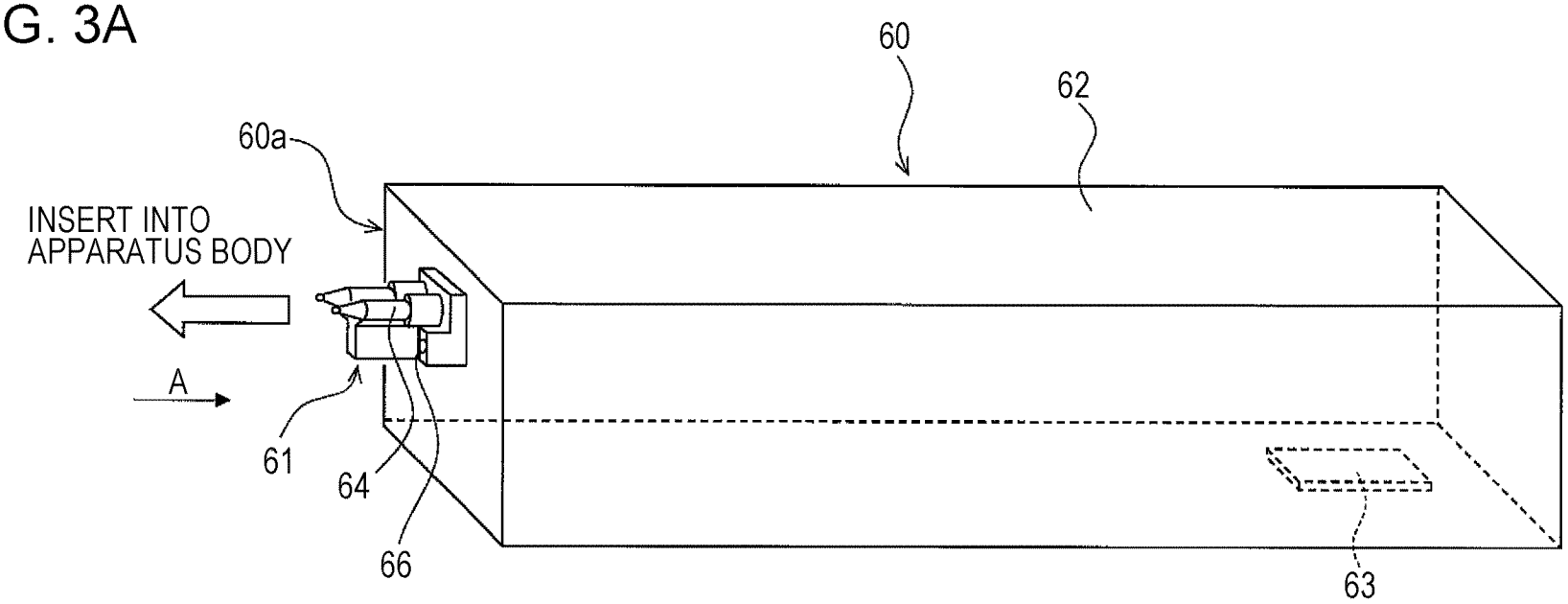
FIGS. 3A and 3B are an explanatory diagram showing a configuration of a toner cartridge that is mounted into the image forming apparatus and a diagram showing the toner cartridge as seen from an angle indicated by arrow A in FIG. 3A, respectively.
Figure 3B:
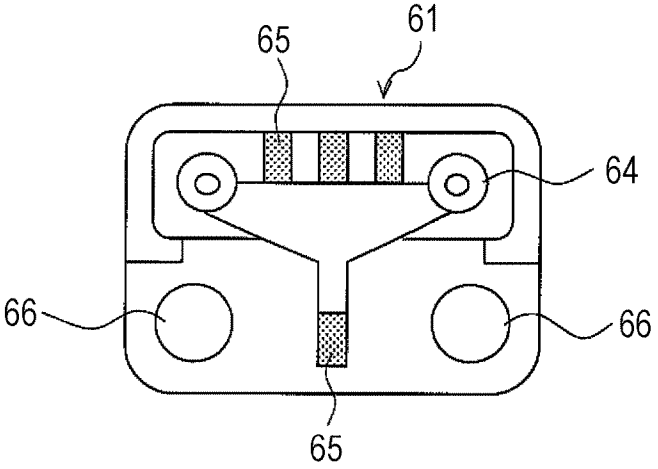

FIGS. 3A and 3B are an explanatory diagram showing a configuration of a toner cartridge 60 that is mounted into the image forming apparatus 1 according to the first embodiment and a diagram showing the toner cartridge 60 as seen from an angle indicated by arrow A in FIG. 3A, respectively.

As shown in FIG. 1, a toner cartridge 60 for use in the image forming apparatus 1 is detachably inserted in the image forming process section 3. The toner cartridge 60 is detached with the outer cover 3*a* opened.

As shown in FIG. 3A, the toner cartridge 60 is constituted by a columnar body and includes a toner accommodating section 62 in which replenishing toner is accommodated.

The toner accommodating section 62 has a toner replenishing port 63 provided in the bottom (lower side in the drawing) thereof.

The toner cartridge 60 has a first end 60*a* that is mounted toward an image forming apparatus 1 body, and the first end 60*a* is provided with a storage section (storage unit) 61 in which consumable information is stored.

The storage section 61 is constituted using any of IC chips (e.g. nonvolatile memories such as wireless IC tags and contact-type CRUMs) and two-dimensional codes such as bar codes and QR codes (registered trademark). In the first embodiment, the storage section 61 includes a contact-type CRUM, which is a nonvolatile memory that is constituted by a device or the like containing an EEPROM or the like storing information regarding the toner cartridge 60, and this memory stores information such as the model number of the toner cartridge 60, the place of manufacture of the toner cartridge 60, the amount of toner that remains in the toner cartridge 60 (which is sequentially updated), whether the toner cartridge 60 is new, and the serial number of the apparatus into which the toner cartridge 60 has been inserted.

As shown in FIGS. 3A and 3B, the storage section 61 is provided with a storage section positioning boss 64. The storage section positioning boss 64 is a positioning member for positioning the storage section 61 with respect to a storage section connector (not illustrated) on the side of the image forming apparatus 1 body in inserting the toner cartridge 60 into the image forming apparatus 1. In FIGS. 3A and 3B, signs 65 and 66 denote connection terminals and attachment holes for attaching the storage section 61 to the toner cartridge 60, respectively.

The toner is replenished from the toner cartridge 60 to the outside by replenishing the toner to the outside through the toner replenishing port 63 by driving a toner conveying motor 68 (not illustrated in FIGS. 3A and 3B; see FIG. 5) to rotate a toner conveying member (not illustrated).

The following describes the characteristic configuration of the image forming apparatus 1 with reference to a block diagram.

Figure 4:
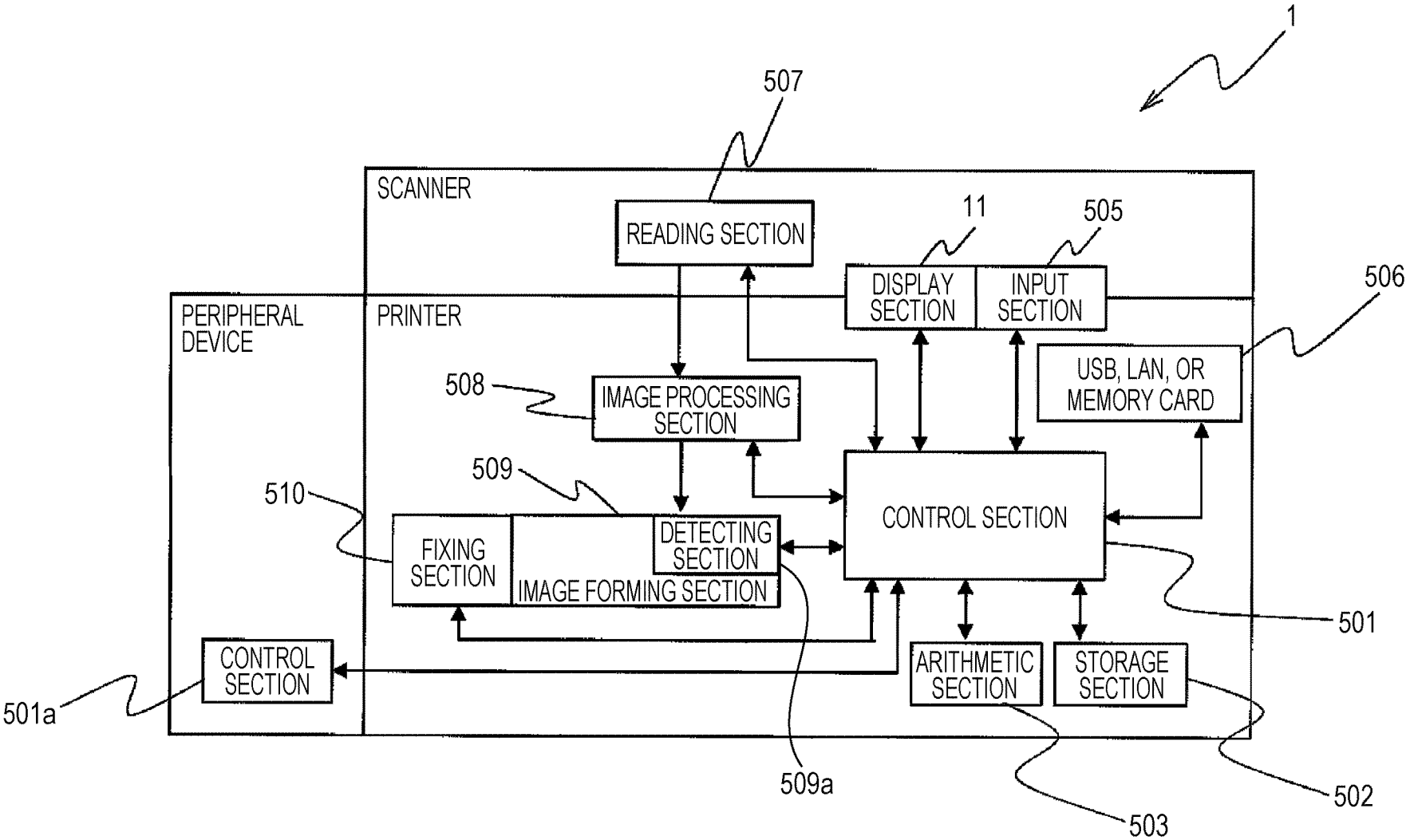
FIG. 4 is a block diagram showing a configuration of the image forming apparatus.
Figure 5:
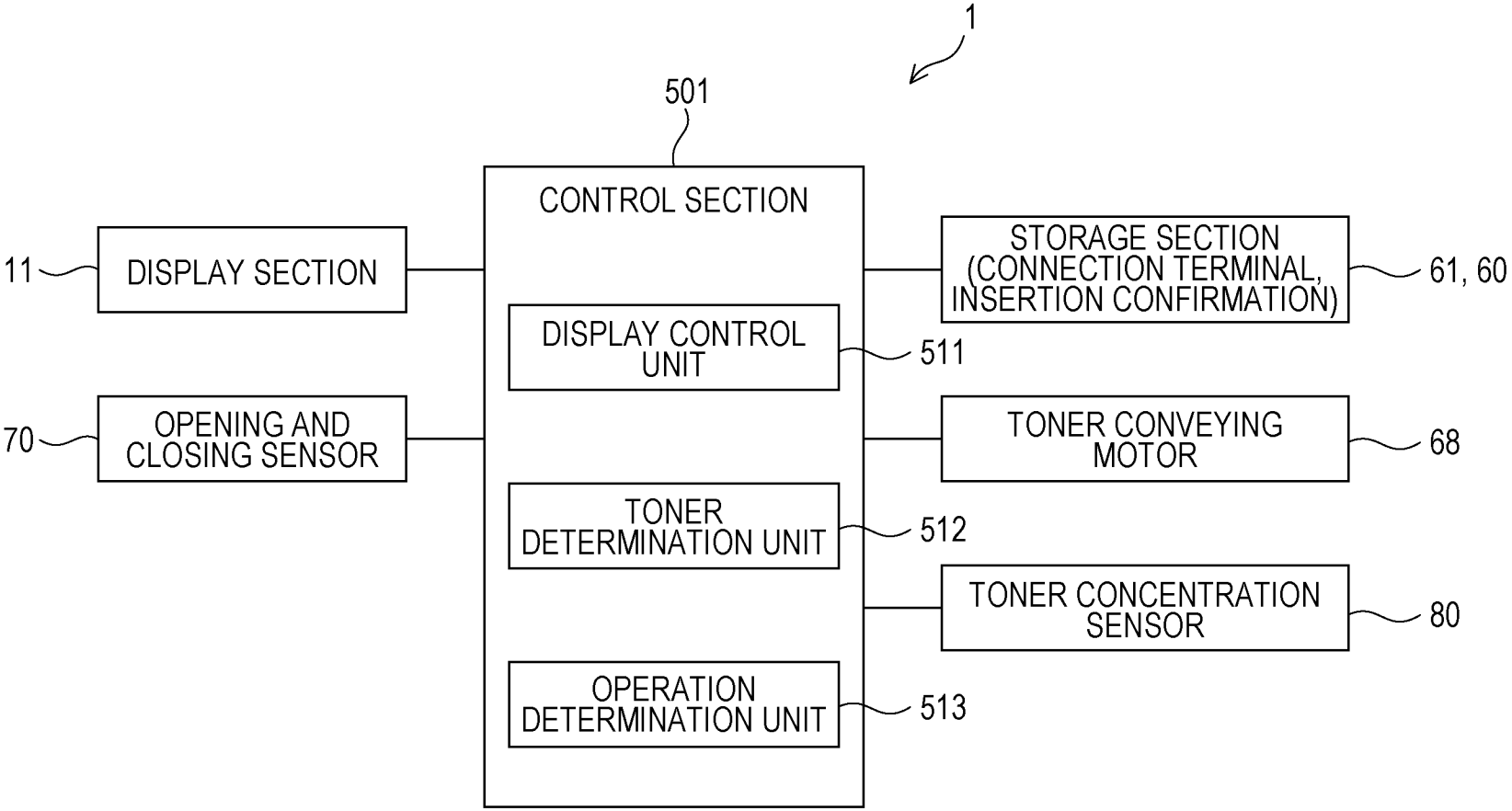
FIG. 5 is a block diagram showing a configuration of a control section of the image forming apparatus.

FIG. 4 is a block diagram showing a configuration of the image forming apparatus 1 according to the first embodiment. FIG. 5 is a block diagram showing a configuration of the control section 501 of the image forming apparatus 1.

As shown in FIG. 4, the image forming apparatus 1 includes, as electrical components, the control section 501, which controls how the image forming apparatus 1 operates, a storage section 502, an arithmetic section 503, the display section 11, an input section 505, a communication section 506 that makes a LAN connection or the like to a PC or the like via a network line, an image processing section 508 that performs image processing, an image forming section 509 that performs image formation, a fixing section 510 that performs a process of fixing a toner image, a reading section 507 that reads an image with a scanner, a control section 501*a* that controls how the post-processing device 5 (which refers to the peripheral device of FIG. 4) operates, and the like.

In the first embodiment, the image forming apparatus 1 includes a detecting section (toner information detecting unit) 509*a* that detects information stored in the storage section 61 of a toner cartridge 60.

By the detecting section 509*a*, information on a toner cartridge 60 or toner that a user is using in the image forming apparatus 1 is detected from the storage section 61.

The arithmetic section 503 includes a function (number-of-prints calculating unit) of calculating the number of prints in accordance with the usage state of the toner.

As information on the toner cartridge 60, a time for which the toner cartridge 60 is unused (e.g. a time from the end of the last print to a restart), temperature information on toner cartridge operating conditions, and the like are stored.

The image forming section 509 is provided with a toner concentration sensor 80 (see FIG. 5) that detects a toner concentration in which an image is formed. On the basis of a result of detection yielded by the toner concentration sensor 80, the control section 501 allows toner replenishment to be adequately performed from the toner cartridge 60.

As shown in FIG. 5, the control section 501 is connected to the display section 11, the opening and closing sensor 70, the storage section 61 of the toner cartridge 60, the toner conveying motor 68, and the toner concentration sensor 80 so as to confirm a toner cartridge 60 or toner or control toner replenishment.

Furthermore, the controller 501 is characterized by including a display control unit 511, a toner determination unit 512, and an operation determination unit 513.

The display control unit 511 is a unit that, when a toner cartridge 60 is first inserted or a toner cartridge 60 is replaced, causes the display section 11 to display a display that gives instructions to perform an operation of shaking the toner cartridge 60.

A possible example of the display that gives instruction in the operation of shaking the toner cartridge 60 is a message (character information) such as "SHAKE AND INSERT TONER CARTRIDGE" and, in addition to the message, an image (illustration) or an moving image representing the operation of shaking the toner cartridge 60.

The toner determination unit 512 is a unit that determines whether toner in a toner cartridge 60 has solidified. In the first embodiment, the toner determination unit 512 is configured to, in a case where a toner cartridge 60 is first inserted or a toner cartridge 60 is replaced, determine that toner in the toner cartridge 60 has solidified, as the toner cartridge 60 may have solidified toner therein, depending on the storage period.

The display control unit 511 is configured to, in a case where it has been determined, on that basis of a result of determination yielded by the toner determination unit 512, that the toner in the toner cartridge 60 has solidified, causes the display section 11 to display a display that gives instruction in an operation of shaking the toner cartridge 60.

The operation determination unit 513 is a unit that determines whether a user has performed the operation of shaking the toner cartridge 60 as displayed on the display section 11. In a case where it has been determined, on the basis of a result of determination yielded by the operation determination unit 513, that a user has performed the operation of shaking the toner cartridge 60 as displayed on the display section 11, it is determined that the toner has been loosened into a normal toner state.

In the first embodiment, in a case where a toner cartridge 60 is first inserted or a toner cartridge 60 is replaced, the toner cartridge 60 is detected by the connection terminals 65 of the toner cartridge 60 being connected in the image forming section 509 after confirmation of a display that gives instruction in an operation of shaking the toner cartridge 60, and when it has been confirmed that the toner cartridge 60 has been inserted, the operation determination unit 513 determines that the operation of shaking the toner cartridge 60 has ended.

An example of a display that is displayed on the display section 11 by the display control unit 511 and gives instruction in an operation of shaking a toner cartridge 60 is described here with reference to the drawings.

Figure 6:
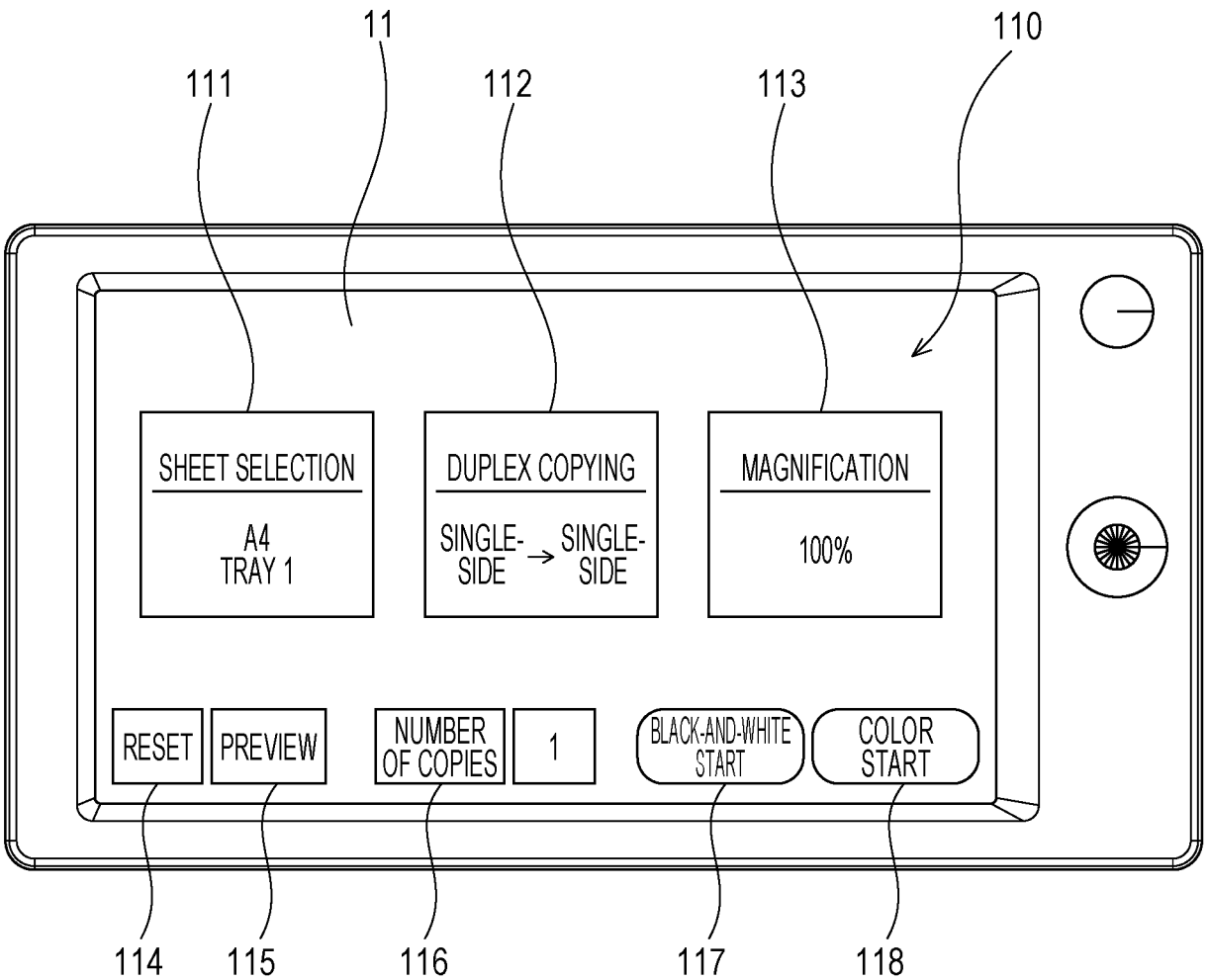
FIG. 6 is an explanatory diagram showing an example of a printing operation screen that is displayed on a display section of the image forming apparatus.
Figure 7:
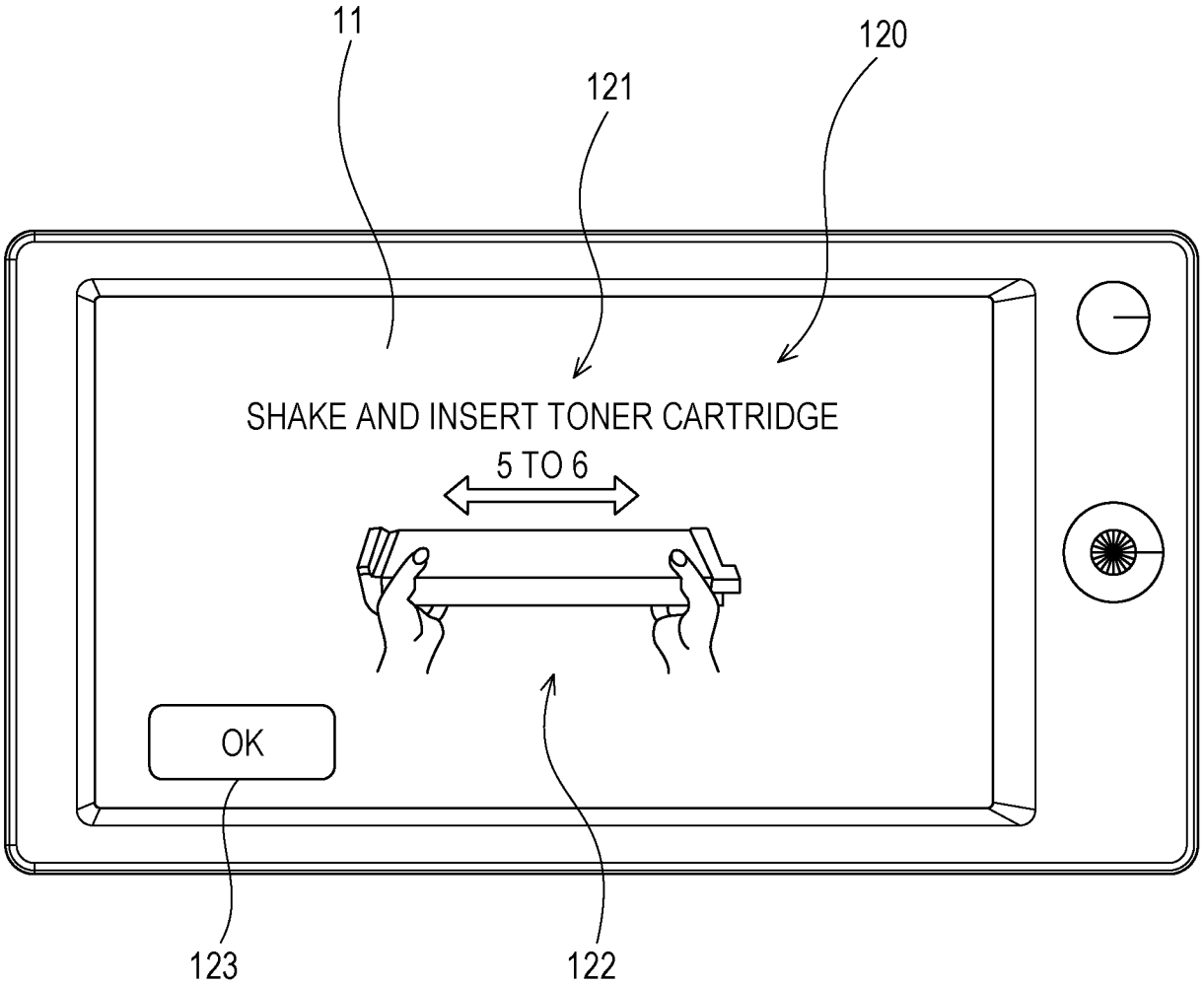
FIG. 7 is an explanatory diagram showing an example of a message screen that is displayed on the display section and instructs a user in an operation of shaking a toner cartridge.
Figure 8:
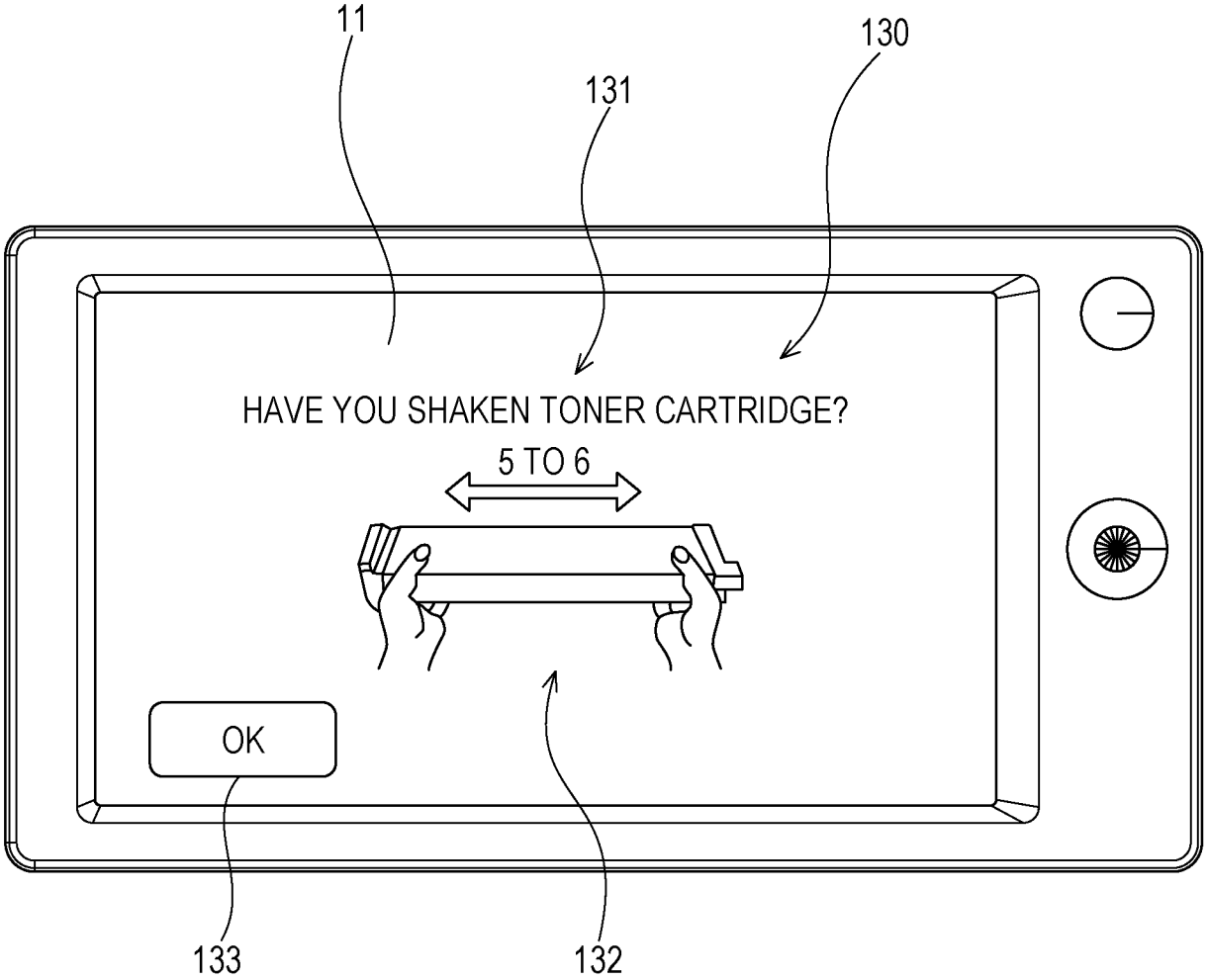
FIG. 8 is an explanatory diagram showing an example of a message screen that is displayed on the display section for confirmation of the operation of shaking the toner cartridge.
Figure 9:
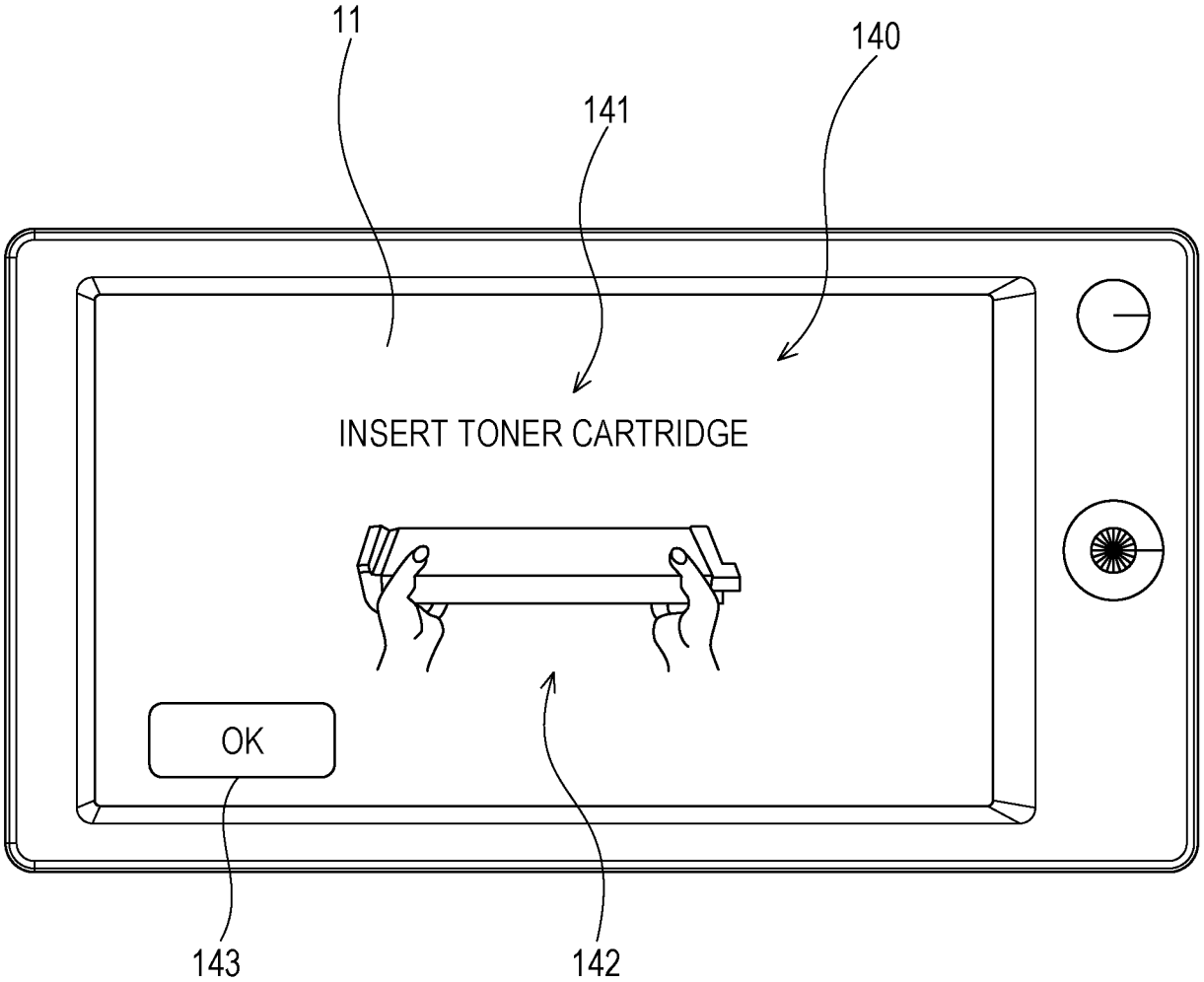
FIG. 9 is an explanatory diagram showing an example of a message screen that is displayed on the display section and gives instruction in inserting the toner cartridge.

FIG. 6 is an explanatory diagram showing an example of a printing operation screen that is displayed on the display section 11 of the image forming apparatus 1 according to the first embodiment. FIG. 7 is an explanatory diagram showing an example of a message screen that is displayed on the display section 11 and instructs a user in an operation of shaking a toner cartridge 60. FIG. 8 is an explanatory diagram showing an example of a message screen that is displayed on the display section 11 for confirmation of the operation of shaking the toner cartridge 60. FIG. 9 is an explanatory diagram showing an example of a message screen that is displayed on the display section 11 and gives instruction in inserting the toner cartridge 60.

The image forming apparatus 1 is configured such that in a case where a toner cartridge 60 is first inserted or in a case where a toner cartridge 60 is replaced in performing a printing process, the display section 11 switches, for example, from displaying a printing operation screen 110, shown in FIG. 6, on which to perform a printing process operation to displaying a first message screen 120, shown in FIG. 7, that gives instruction in an operation of shaking the toner cartridge 60.

As shown in FIG. 6, the printing operation screen 110 displays a sheet selection button 111, a copy surface selection button 112, a magnification selection button 113, a reset button 114, a preview button 115, a number-of-copies input button 116, a black-and-white copy start button 117, and a color copy start button 118.

The first message screen 120 displays a first message 121 "SHAKE AND INSERT TONER CARTRIDGE", an explanatory image (illustration) 122 of shaking (waggling) the toner cartridge 60 from side to side, and a confirmation button 123. The first message screen 120 is an explanatory screen that gives instruction in the operation of shaking the toner cartridge 60 and explains how to shake the toner cartridge 60. On this screen, an operation of performing a printing process is disabled.

Then, once the confirmation button 123 is touched, the display section 11 switches from displaying the first message screen 120 to displaying a second message screen 130 as shown in FIG. 8.

The second message screen 130 displays a second message 131 "HAVE YOU SHAKEN TONER CARTRIDGE?", an explanatory image (illustration) 132 of shaking (waggling) the toner cartridge 60 from side to side, and a confirmation button 133. The second message screen 130 is a confirmation screen that confirms that the toner cartridge 60 has been shaken.

Then, once the confirmation button 133 is touched, the display section 11 switches from displaying the second message screen 130 to displaying a third message screen 140 as shown in FIG. 9.

The third message screen 140 displays a third message 141 "INSERT TONER CARTRIDGE", an explanatory image (illustration) 142 of holding the toner cartridge 60, and a confirmation button 143. The third message screen 140 is an instruction screen that gives instruction in inserting the toner cartridge 60.

Then, once the confirmation button 143 is touched, the display section 11 switches from displaying the third message screen 140 to displaying the printing operation screen 110 again as shown in FIG. 6. In a case where the toner cartridge 60 has not been inserted into the apparatus, the printing operation screen 110 is not displayed.

The following describes, with reference to a flow chart, a procedure in which, in performing a printing process, the image forming apparatus 1 according to the first embodiment instructs a user to display an operation of loosening toner by shaking a toner cartridge 60 to be used.

Figure 10:
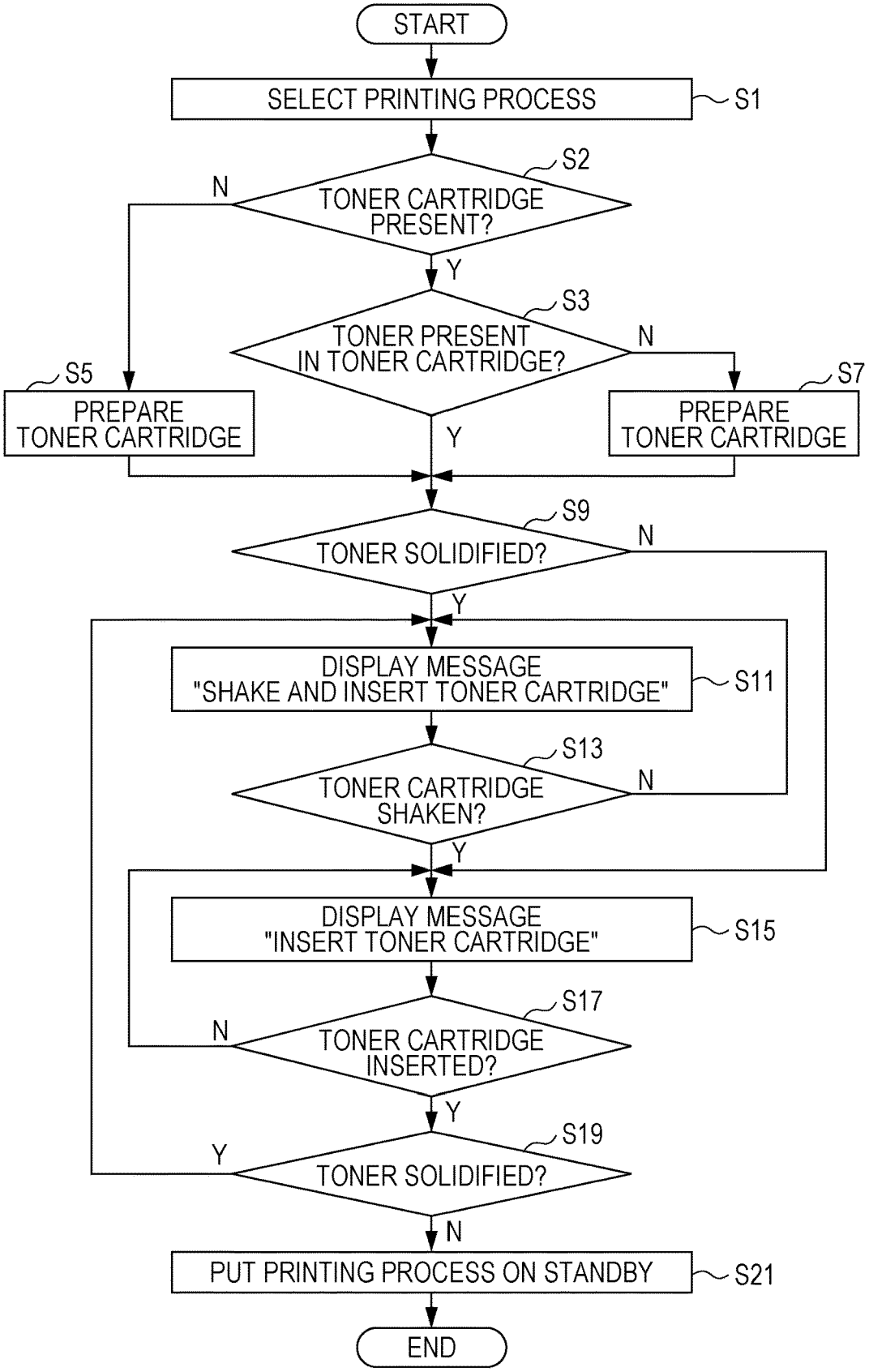
FIG. 10 is a flow chart showing a procedure for, in inserting a toner cartridge to be used in the image forming apparatus, displaying a message screen that instructs a user in an operation of shaking the toner cartridge.

FIG. 10 is a flow chart showing a procedure for, in inserting a toner cartridge 60 to be used in the image forming apparatus 1 according to the first embodiment, displaying a message screen that instructs a user in an operation of shaking the toner cartridge 60.

As shown in FIG. 10, once an operation by the image forming apparatus 1 is started and a printing process is selected (step S1), it is determined whether a toner cartridge 60 is present (step S2).

In a case where it has been determined in step S2 that a toner cartridge 60 is present, the process proceeds to step S3.

In a case where it has been determined in step S3 that toner is present in the toner cartridge 60, the process proceeds to step S9, in which the state of the toner is determined.

On the other hand, in a case where it has been determined in step S2 that no toner cartridge 60 is present, a toner cartridge 60 is prepared and the process proceeds to step S9 (step S5).

Alternatively, in a case where it has been determined in step S3 that no toner is present in the toner cartridge 60, a replacing toner cartridge 60 is prepared and the process proceeds to step S9 (step S7).

In step S9, in a case where a toner cartridge 60 is first inserted or in a case where a toner cartridge 60 is replaced, it is determined that toner in a toner cartridge 60 that has been stored has solidified. Further, in a case where toner is present in the toner cartridge 60 in step S3, it is determined in step S9 whether the toner has solidified.

In a case where it has been determined in step S9 that the toner in the toner cartridge 60 has solidified, the display section 11 displays the first message screen 120, shown in FIG. 7, which displays the first message 121 "SHAKE AND INSERT TONER CARTRIDGE", the explanatory image (illustration) 122 of shaking (waggling) the toner cartridge 60 from side to side, and the confirmation button 123 (step S11).

Once the user touches the confirmation button 123 after performing an operation of shaking the toner cartridge 60, the display section 11 displays the second message screen 130, shown in FIG. 8, which displays the second message 131 "HAVE YOU SHAKEN TONER CARTRIDGE?", the explanatory image (illustration) 132 of shaking (waggling) the toner cartridge 60 from side to side, and the confirmation button 133, so that it is confirmed whether the toner cartridge 60 has been shaken (step S13).

In a case where it has been confirmed, with the touch of the confirmation button 133 in step S13, that the toner cartridge 60 has been shaken, the process proceeds to step S15, in which the display section 11 displays the third message screen 140, shown in FIG. 9, which displays the third message 141 "INSERT TONER CARTRIDGE", the explanatory image (illustration) 142 of holding the toner cartridge 60, and the confirmation button 143. Then, the process proceeds to step S17.

On the other hand, in a case where it is not conformed in step S13 that the toner cartridge 60 has been shaken, the process returns to step S11, in which the operation of shaking the toner cartridge 60 is repeated.

In step S17, it is determined whether the toner cartridge 60 has been inserted into the apparatus. The determination as to whether the toner cartridge 60 has been inserted into the apparatus is made by determining, through the sensing of the connection terminals 65 of the toner cartridge 60, whether the toner cartridge 60 has been inserted into the apparatus body.

In a case where it has been determined in step S17 that the toner cartridge 60 has been inserted into the apparatus, the process proceeds to step S19, in which it is determined whether the toner in the toner cartridge 60 has solidified. The determination as to whether the toner in the toner cartridge 60 has solidified is made on the basis of a value of drive torque of the toner conveying motor 68. For example, in a case where the value of drive torque is smaller after the toner cartridge 60 has been inserted again than before the toner cartridge 60 is removed, it is determined that the toner in the toner cartridge 60 has not solidified.

On the other hand, in a case where it has been determined in step S17 that the toner cartridge 60 has not been inserted into the apparatus, the process returns to step S15, in which the toner cartridge 60 is inserted into the apparatus.

In a case where it has been determined in step S19 that the toner in the toner cartridge 60 has solidified, the process returns to step S11, in which the operation of shaking the toner cartridge 60 is repeated.

On the other hand, in a case where it has been determined in step S19 that the toner in the toner cartridge 60 has not solidified, the process proceeds to step S21, in which the printing process is put on standby, so that the steps for loosening the toner in the toner cartridge 60 end.

As noted above, the image forming apparatus 1 according to the first embodiment that is replenished with toner by using a toner cartridge 60 is configured such that in a case where a toner cartridge 60 is first inserted or a toner cartridge 60 is replaced, the display section 11 displays a message screen (first message screen 120, second message screen 130, third message screen 140) that instructs a user in an operation of shaking the toner cartridge 60, whereby a new toner cartridge 60 that has been stored is shaken so that the toner cartridge 60 is inserted after toner in the toner cartridge 60 has been loosened, which makes it possible to prevent a printing failure from occurring due to an abnormality in toner replenishment without normal toner replenishment with the toner in a solid state.

Although, in the first embodiment, the determination as to whether the toner cartridge 60 has been inserted into the apparatus is made through the sensing of the connection terminals 65 of the toner cartridge 60, this does not imply any limitation.

For example, by detecting, with the opening and closing sensor 70, an operation of opening and closing the outer cover 3*a*, which opens and closes an accommodating section of the apparatus body that accommodates the toner cartridge 60, it may be determined that the toner cartridge 60 has been inserted.

Further, although, in the first embodiment, the determination as to whether the toner cartridge 60 has been shaken is made by confirming, by touching the confirmation button 133 on the second message screen 130 to be confirmed, that the toner cartridge 60 has been shaken, this does not imply any limitation.

For example, by providing the toner cartridge 60 with a counter (e.g. a shake counter) that counts shaking, the determination may be made according to whether the number of times thus counted has reached a predetermined number of times.

Further, by causing the display section 11 to display a message to the effect that a display screen is touched every time an operation of shaking the toner cartridge 60 is performed and, after displaying the message, counting every time the user performs a touch operation on the display screen, the determination may be made according to whether the touch operation has reached a predetermined number of times.

Second Embodiment

The following describes a second embodiment.

The second embodiment is characterized in that in performing a printing process, the image forming apparatus 1 performs a display that, according to the state of toner in a toner cartridge 60 being used, instructs a user in an operation of loosening the toner by shaking the toner cartridge 60.

The following describes, with reference to a flow chart, a procedure in which, in performing a printing process, the image forming apparatus 1 displays, according to the state of toner in a toner cartridge 60 being used, an operation of loosening the toner by shaking the toner cartridge 60.

Figure 11:
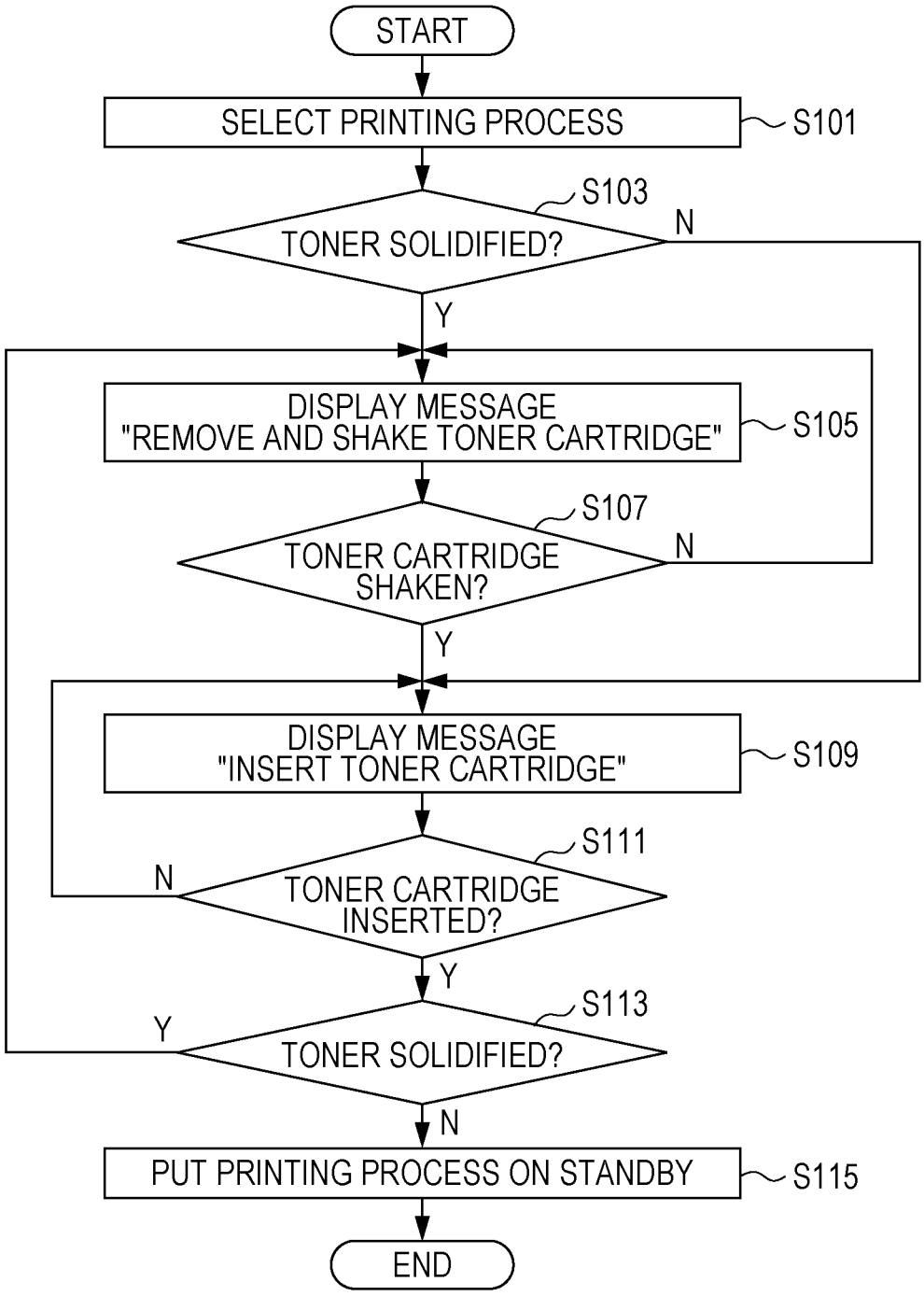
FIG. 11 is a flow chart showing a procedure for displaying, according to the state of toner in a toner cartridge to be used in an image forming apparatus according to a second embodiment, a message screen that instructs a user in an operation of shaking the toner cartridge.
Figure 12:
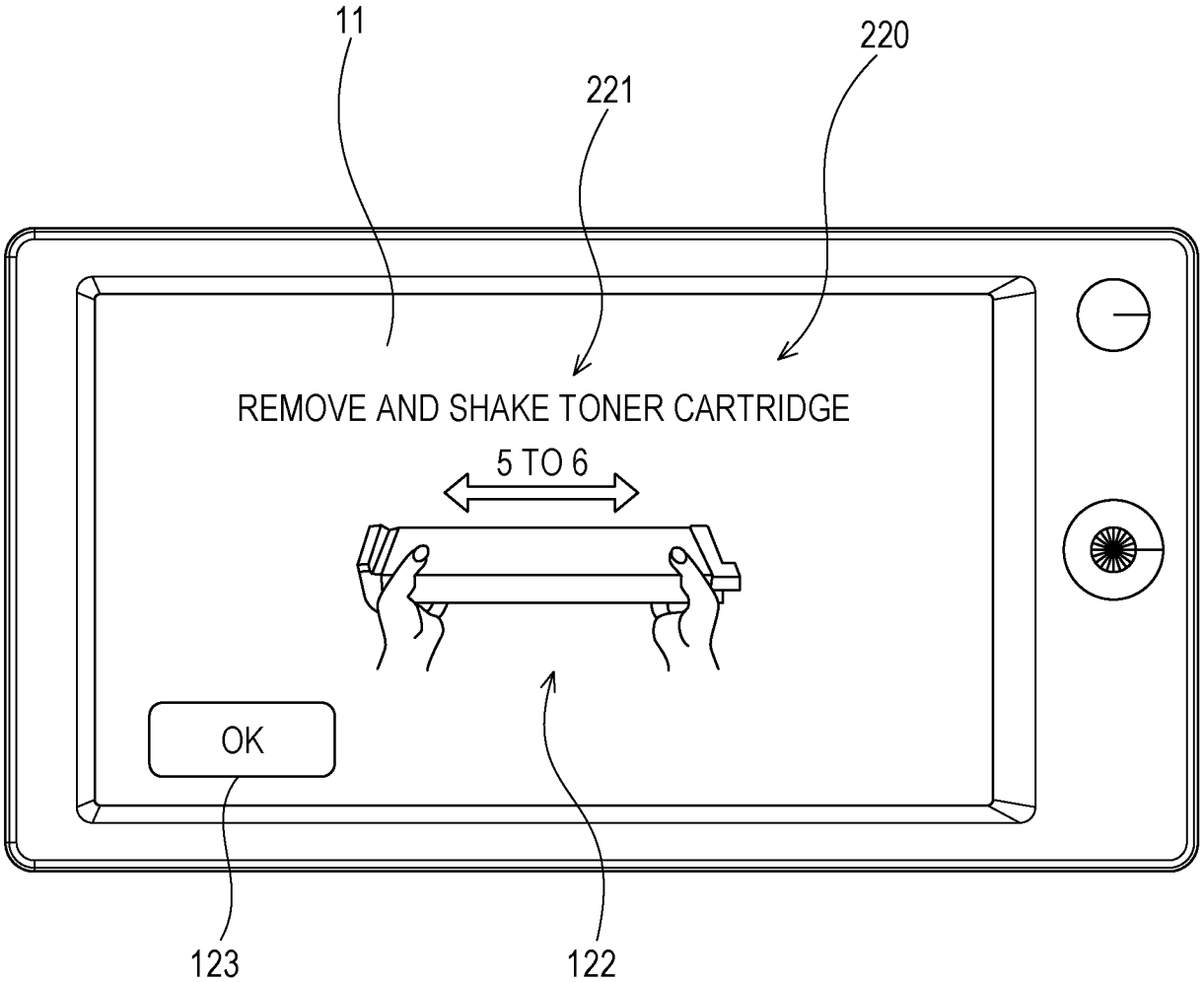
FIG. 12 is an explanatory diagram showing an example of a message screen that is displayed on the display section and instructs a user in an operation of shaking a toner cartridge.

FIG. 11 is a flow chart showing a procedure for displaying, according to the state of toner in a toner cartridge 60 to be used in the image forming apparatus 1 according to the second embodiment, a message screen that instructs a user in an operation of shaking the toner cartridge 60. FIG. 12 is an explanatory diagram showing an example of a message screen that is displayed on the display section 11 and instructs a user in an operation of shaking a toner cartridge 60.

As shown in FIG. 11, once an operation by the image forming apparatus 1 is started and a printing process is selected (step S101), it is determined whether toner in a toner cartridge 60 has solidified (step S103).

In the second embodiment, a determination of the state of toner in a toner cartridge 60 being used is made on the basis of a result of detection yielded by the toner concentration sensor 80. In a case where a transition is not occurring in normal toner concentrations, it is determined that toner replenishment is not normally performed, so that it is determined that the toner has solidified.

In a case where it has been determined in step S103 that the toner in the toner cartridge 60 has solidified, the display section 11 displays a first message screen 220, shown in FIG. 12, that displays a first message 221 "REMOVE AND SHAKE TONER CARTRIDGE", the explanatory image (illustration) 122 of shaking (waggling) the toner cartridge 60 from side to side, and the confirmation button 123 (step S105).

Once the user touches the confirmation button 123 after performing an operation of shaking the toner cartridge 60, the display section 11 displays the second message screen 130, shown in FIG. 8, which displays the second message 131 "HAVE YOU SHAKEN TONER CARTRIDGE?", the explanatory image (illustration) 132 of shaking (waggling) the toner cartridge 60 from side to side, and the confirmation button 133, so that it is confirmed whether the toner cartridge 60 has been shaken (step S107).

In a case where it has been confirmed, with the touch of the confirmation button 133 in step S107, that the toner cartridge 60 has been shaken, the process proceeds to step S109, in which the display section 11 displays the third message screen 140, shown in FIG. 9, which displays the third message 141 "INSERT TONER CARTRIDGE", the explanatory image (illustration) 142 of holding the toner cartridge 60, and the confirmation button 143.

On the other hand, in a case where it is not conformed in step S107 that the toner cartridge 60 has been shaken, the process returns to step S105, in which the operation of shaking the toner cartridge 60 is repeated.

In step S111, it is determined whether the toner cartridge 60 has been inserted into the apparatus.

In a case where it has been determined in step S111 that the toner cartridge 60 has been inserted into the apparatus, the process proceeds to step S113, in which it is determined whether the toner in the toner cartridge 60 has solidified.

On the other hand, in a case where it has been determined in step S111 that the toner cartridge 60 has not been inserted into the apparatus, the process returns to step S109, in which the toner cartridge 60 is inserted into the apparatus.

In a case where it has been determined in step S113 that the toner in the toner cartridge 60 has solidified, the process returns to step S105, in which the operation of shaking the toner cartridge 60 is repeated.

On the other hand, in a case where it has been determined in step S113 that the toner in the toner cartridge 60 has not solidified, the process proceeds to step S115, in which the printing process is put on standby, so that the steps for loosening the toner in the toner cartridge 60 end.

As noted above, the image forming apparatus 1 according to the second embodiment that is replenished with toner by using a toner cartridge 60 is configured such that in a case where a printing operation is executed by a toner cartridge 60 being used, the display section 11 displays a message screen (first message screen 120, second message screen 130, third message screen 140) that, in a case where it has been determined that toner has solidified, instructs a user in an operation of shaking the toner cartridge 60, whereby the toner cartridge 60 being used is removed and shaken so that the toner cartridge 60 is inserted after the toner in the toner cartridge 60 has been loosened, which makes it possible to prevent a printing failure from occurring due to an abnormality in toner replenishment without normal toner replenishment with the toner in a solid state.

Third Embodiment

The following describes a third embodiment.

The third embodiment is characterized in that in performing a printing process, the image forming apparatus 1 performs a display that, according to the state of toner in a toner cartridge 60 being used, instructs a user in an operation of loosening the toner by shaking the toner cartridge 60 and, in particular, as shown in FIG. 5, determines the state of the toner in the toner cartridge 60 according to the value of drive torque of the toner conveying motor 68.

In the third embodiment, a determination of the state of toner in a toner cartridge 60 being used is made on the basis of the value of drive torque of the toner conveying motor 68. For example, when the value of drive torque has become a predetermined value or larger or in a case where the value of drive torque fluctuates greatly in comparison with a normal fluctuating value, it is determined that toner replenishment is not normally performed, so that it is determined that the toner has solidified.

As noted above, the image forming apparatus 1 according to the third embodiment that is replenished with toner by using a toner cartridge 60 is configured such that in a case where a printing operation is executed by a toner cartridge 60 being used, it is possible to easily determine, on the basis of the value of drive torque of the toner conveying motor 68, whether toner has solidified. Moreover, on the basis of the determination, the display section 11 displays a message screen that instructs a user in an operation of shaking the toner cartridge 60, whereby the toner cartridge 60 being used is removed and shaken so that the toner cartridge 60 is inserted after the toner in the toner cartridge 60 has been loosened, which makes it possible to prevent a printing failure from occurring due to an abnormality in toner replenishment without normal toner replenishment with the toner in a solid state.

Fourth Embodiment

The following describes a fourth embodiment.

The fourth embodiment is characterized in that in performing a printing process, the image forming apparatus 1 performs a display that, according to the state of toner in a toner cartridge 60 being used, instructs a user in an operation of loosening the toner by shaking the toner cartridge 60 and, in particular, as shown in FIG. 5, makes a determination on the basis of a temperature of the operating conditions of the toner cartridge 60 that is included in toner information stored in the storage section 61 of the toner cartridge 60.

In the fourth embodiment, a determination of the state of toner in a toner cartridge 60 being used is made on the basis of the toner information stored in the storage section 61. For example, in a case where the temperature of the operating conditions of the toner cartridge 60 has assumed a high-temperature state that exceeds a predetermined value, it is determined that toner replenishment is not normally performed, so that it is determined that the toner has solidified.

As noted above, the image forming apparatus 1 according to the fourth embodiment that is replenished with toner by using a toner cartridge 60 is configured such that in a case where a printing operation is executed by a toner cartridge 60 being used, it is possible to easily determine, on the basis of the temperature of the operating conditions of the toner cartridge 60 that is included in the toner information stored in the storage section 61 of the toner cartridge 60, whether toner has solidified. Moreover, on the basis of the determination, the display section 11 displays a message screen that instructs a user in an operation of shaking the toner cartridge 60, whereby the toner cartridge 60 being used is removed and shaken so that the toner cartridge 60 is inserted after the toner in the toner cartridge 60 has been loosened, which makes it possible to prevent a printing failure from occurring due to an abnormality in toner replenishment without normal toner replenishment with the toner in a solid state.

Fifth Embodiment

The following describes a fifth embodiment.

The fifth embodiment is characterized in that in performing a printing process, the image forming apparatus 1 performs a display that, according to the state of toner in a toner cartridge 60 being used, instructs a user in an operation of loosening the toner by shaking the toner cartridge 60 and, in particular, as shown in FIG. 5, makes a determination on the basis of a period of non-use (unused period) of the toner cartridge 60 that is included in the toner information stored in the storage section 61 of the toner cartridge 60.

In the fifth embodiment, a determination of the state of toner in a toner cartridge 60 being used is made on the basis of the toner information stored in the storage section 61. For example, in a case where the unused period of non-use of the toner cartridge 60 is longer than a predetermined period, it is determined that the toner has solidified.

As noted above, the image forming apparatus 1 according to the fifth embodiment that is replenished with toner by using a toner cartridge 60 is configured such that in a case where a printing operation is executed by a toner cartridge 60 being used, it is possible to easily determine, on the basis of the length of the unused period of the toner cartridge 60 that is included in the toner information stored in the storage section 61 of the toner cartridge 60, whether toner has solidified. Moreover, on the basis of the determination, the display section 11 displays a message screen that instructs a user in an operation of shaking the toner cartridge 60, whereby the toner cartridge 60 being used is removed and shaken so that the toner cartridge 60 is inserted after the toner in the toner cartridge 60 has been loosened, which makes it possible to prevent a printing failure from occurring due to an abnormality toner replenishment without normal toner replenishment with the toner in a solid state.

The present disclosure contains subject matter related to that disclosed in Japanese Priority Patent Application JP 2017-101830 filed in the Japan Patent Office on May 23, 2017, the entire contents of which are hereby incorporated by reference.

As noted above, the present disclosure is not limited to the aforementioned embodiments, but may be altered in various ways within the scope of the claims. An embodiment based on a combination of technical means altered as appropriate without departing from the scope of the present disclosure is encompassed in the technical scope of the present disclosure.

What is claimed is:

1. An image forming apparatus that is replenished with toner by using a toner container that is detachable from an apparatus body and a toner conveying motor that conveys the toner from the toner container, the toner container comprising a storage memory provided with an electric connection terminal and at least one positioning boss, the image forming apparatus comprising:

an image forming component having a toner concentration sensor that detects toner solidification in the toner container;

a display control component having a function of causing a display section of the image forming apparatus to display a printing operation display including at least one printing process to be performed; and an operation determination component that determines whether a user has performed the operation of shaking the toner container as instructed by a first message display, wherein when (a1) attachment of the toner container to the apparatus body is detected and (a2) the toner solidification is detected by a value of drive torque of the toner conveying motor, the display control component causes the display section to switch from the printing operation display to the first message display that gives illustrated instructions in an operation of shaking the attached toner container with a confirmation button, when the first message display is displayed, operation of the at least one printing process is disabled, and when (b1) the confirmation button is operated and (b2) reattachment of the toner container is detected by the electric connection terminal, the operation determination component determines that the user has performed the operation of shaking the toner container as instructed by the first message display, and the storage memory stores a residual amount of the toner.

2. The image forming apparatus according to claim 1, wherein the display control component causes the display section to switch to the first message display when the toner container is first inserted or when the toner container is replaced.

3. The image forming apparatus according to claim 1, wherein the display control component causes the display section to switch to the first message display according to a status of use of the toner container.

4. The image forming apparatus according to claim 1, wherein the display control component performs the first message display in a case where it has been determined, on the basis of a result of determination yielded by the value of drive torque of the toner conveying motor or a sensor value of the toner concentration sensor, that the toner in the toner container has solidified.

5. The image forming apparatus according to claim 4, wherein in a case where the drive torque of the toner conveying motor rises, it is determined that the toner in the toner container has solidified.

6. The image forming apparatus according to claim 1, wherein in a case where operating conditions of the toner container have been in a state of exceeding a predetermined temperature for more than a predetermined period, it has been is determined that the toner in the toner container has solidified, and the display control component performs the first message display.

7. The image forming apparatus according to claim 1, wherein in a case where a period of non-use of the toner container exceeds a predetermined period, it is determined that the toner in the toner container has solidified, and the display control component performs the first message display.

8. The image forming apparatus according to claim 1, wherein in a case where a storage period of a replacement toner container exceeds a predetermined period, it is determined that the toner in the toner container has solidified, and the display control component performs the first message display.

9. The image forming apparatus according to claim 1, wherein the display control component includes a function of displaying a message to an effect that a part where the first message display is displayed or a display screen is touched every time the operation of shaking the toner container is performed and a counting function of, after displaying the message, counting every time the user performs a touch operation on the message or display screen, and the operation determination component makes a determination according to whether the touch operation has reached a predetermined number of times as counted by the counting function.

10. The image forming apparatus according to claim 1, wherein two positioning bosses are present, and the electric connection terminal protrudes from a surface of the toner container between the two positioning bosses.

* * * * *